United States Patent [19]

Bloom et al.

[11] 4,304,835

[45] Dec. 8, 1981

[54] IMAGE RECEIVING ELEMENTS

[75] Inventors: Stanley M. Bloom, Waban; Boris Levy, Wayland, both of Mass.

[73] Assignee: Polaroid Corporation, Cambridge, Mass.

[21] Appl. No.: 69,282

[22] Filed: Aug. 24, 1979

Related U.S. Application Data

[63] Continuation of Ser. No. 649,201, Jan. 14, 1976, abandoned.

[51] Int. Cl.[3] ..... G03C 7/00

[52] U.S. Cl. ..... 430/228; 430/231; 430/232; 430/510

[58] Field of Search ..... 430/231, 232, 228, 510

[56] References Cited

U.S. PATENT DOCUMENTS

| | | | |
|---|---|---|---|
| 3,615,426 | 10/1971 | Debruyn | 430/228 |
| 3,647,440 | 3/1972 | Rasch | 430/231 |
| 3,894,871 | 7/1975 | Land | 430/228 |

*Primary Examiner*—J. Travis Brown

*Attorney, Agent, or Firm*—Philip G. Kiely

[57] ABSTRACT

A receiving element for use in an additive color photographic diffusion transfer process which comprises a transparent support carrying an additive color screen and a layer comprising noble metal silver precipitating nuclei and a polymer; wherein said nuclei are present in a level of about 0.1–0.3 mgs/ft$^2$, and said polymer is present at a level of from about 0.5 to 5 times the coverage of said nuclei. Preferably, the noble metal is obtained by reduction of a noble metal salt or complex, and more preferably, the noble metal is palladium.

12 Claims, No Drawings

IMAGE RECEIVING ELEMENTS

CROSS REFERENCE TO RELATED APPLICATIONS

This application is a continuation of U.S. patent application Ser. No. 649,201, filed Jan. 14, 1976, now abandoned.

BACKGROUND OF THE INVENTION

Procedures for preparing photographic images in silver by diffusion transfer principles are well known in the art. For the formation of the positive silver images, a latent image contained in an exposed photosensitive silver halide emulsion is developed and almost concurrently therewith, a soluble silver complex is obtained by reaction of a silver halide solvent with the unexposed and undeveloped silver halide of said emulsion. Preferably, the photosensitive silver halide emulsion is developed with a processing composition in a viscous condition which is spread between the photosensitive element comprising the silver halide emulsion and a print-receiving element comprising, preferably, a suitable silver precipitating layer. The processing composition effects development of the latent image in the emulsion and, substantially contemporaneously therewith, forms a soluble silver complex, for example, a thiosulfate or thiocyanate, with undeveloped silver halide. This soluble silver complex is, at least in part, transported in the direction of the print-receiving element and the silver thereof is largely precipitated in the silver precipitating element to form a positive image thereon. Procedures of this description are disclosed, for example, in U.S. Pat. No. 2,543,181 issued to Edwin H. Land. See, also, Edwin H. Land, *One Step Photography,* Photographic Journal, Section A, pp. 7–15, January 1950.

Additive color reproduction may be produced by exposing a photosensitive silver halide emulsion through an additive color screen having filter media or screen elements each of an individual additive color, such as red or green or blue, and by viewing the reversed or positive silver image formed by transfer to a transparent print-receiving element through the same or a similar screen which is suitably registered with the reversed positive image carried by the print-receiving layer.

As examples of suitable film structures for employment in additive color photography, mention may be made of U.S. Pat. Nos. 2,861,885; 2,726,154; 2,944,894; 3,536,488; 3,615,427; 3,615,428; 3,615,429; 3,615,426; and 3,894,871.

The image-receiving elements of the present invention are particularly suited for use in diffusion transfer film units wherein there is contained a positive transfer image and a negative silver image, the two images being in separate layers on a common, transparent support and viewed as a single, positive image. Such positive images may be referred to for convenience as "integral positive-negative images", and more particularly as "integral positive-negative transparencies." Examples of film units which provide such integral positive-negative transparencies are set forth, for example, in the above-indicated U.S. Pat. Nos. 3,536,488; 3,894,871; 3,615,426; 3,615,427; 3,615,428; and 3,615,429.

In general, silver precipitating nuclei comprise a specific class of adjuncts well known in the art as adapted to effect catalytic reduction of solubilized silver halide specifically including heavy metals and heavy metal compounds such as the metals of Groups IB, IIB, IVA, VIA and VIII and the reaction products of Groups IB, IIB, IVA and VIII metals with elements of Group VIA.

Widely used as silver precipitating agents have been those disclosed in U.S. Pat. No. 2,698,237 and specifically the metallic sulfides and selenides, there detailed, these terms being understood to include the selenosulfides, the polysulfides, and the polyselenides. It has been preferred to employ sulfides whose solubility products in an aqueous medium at approximately 20° C. vary between $10^{-23}$ and $10^{-49}$, and especially the salts of zinc. Also particularly suitable as precipitating agents heavy metals such as silver, gold, platinum, palladium, etc., and in this category the noble metals illustrated are preferred and are generally provided in a silica matrix as colloidal particles.

The nucleation layers in the art have generally been found to be in excess of the 1 micron range (about 93 mgs/ft$^2$). See, for example, U.S. Pat. Nos. 3,220,837 and 3,709,687.

U.S. Pat. No. 3,647,440, issued Mar. 7, 1972 discloses receiving layers comprising finely divided non-silver noble metal nuclei obtained by reducing a noble metal salt in the presence of a colloid or binder material with a reducing agent having a standard potential more negative than −0.30. It is the thrust of the patent that a reducing agent having a standard potential more negative than −0.30 must be used in order to obtain nuclei of a specific, usable size range. It is further illustrated that stannous chloride, which does not fall within the standard potential range, does not produce useful nuclei. The binder materials disclosed include gelatin, polyvinyl pyrrolidone, polymeric latices such a copoly (2-chloroethylmethacrylate-acrylic acid), a mixture of polyvinyl alcohol and the interpolymer of n-butyl acrylate, 3-acryloyloxypropane-1-sulfonic acid, sodium salt and 2-acetoacetoxyethyl methacrylate, polyethylene latex, and colloidal silica. THe amount of colloid binder employed ranges from about 5 to 500 mgs/ft$^2$ with the nuclei ranging from 1 to 200 micrograms/ft$^2$.

A novel silver precipitating nuclei system has now been found which possesses advantages not found in the prior art, which system has particular value in silver transfer color images.

SUMMARY OF THE INVENTION

The present invention is directed to a receiving element for use in an additive color diffusion transfer process and comprises a transparent support carrying an additive color screen and a layer of noble metal nuclei and a polymer. The nuclei are present in a range of about 0.1 to 0.3 mgs/ft$^2$, the polymer is present at a coverage of about 0.5 to 5 times that of the nuclei. Thus, the total of the nuclei and polymer together is not greater than about 2 mgs/ft$^2$.

In a preferred embodiment, the noble metal nuclei comprise palladium nuclei. In a particularly preferred embodiment the noble metal nuclei are prepared by reducing a noble metal salt or complex; and, more preferably, reducing with a first metal capable of two valence states.

DETAILED DESCRIPTION OF THE INVENTION

The silver precipitating layers employed in the novel receiving element provide positive silver transfer images at coverages heretofore not employed to taught by the prior art. The relatively thin nucleating layer as well as the small amount of nuclei and the relatively low polymer level is not only unexpected but also unobvious in view of the art. Generally, large excesses of polymer or other binder compared to nuclei are employed.

The noble metals employed in the present invention include silver, gold, palladium and platinum. However, particularly superior results are achieved at the specified coverages with palladium and, for convenience, the invention will be described primarily in terms of this preferred embodiment.

Superior photographic results are obtained employing the palladium metal nuclei in a gelatin or hydroxyethyl cellulose polymer, particularly with respect to silver image tone and density.

While the amount of noble metal nuclei may range over the range indicated, particularly advantageous results are obtained at a level of about 0.15 to 0.25 mgs/ft$^2$, and more particularly, at a level of about 0.2 mgs/ft$^2$.

In a preferred embodiment, the polymer is employed at a level of about 0.5 to 5 times the coverage of the noble metal nuclei. It is surprising that such a relatively small amount of polymer can be employed without precipitation or settling of the noble metal, while at the same time obtaining the sensitometric properties desired, particularly silver image tone. In addition, a more neutral image tone is achieved as gelatin at the lower level of the polymer range is employed.

The noble metal nuclei are preferably obtained by the reduction of a noble salt or complex. In a preferred embodiment, the reduction is carried out by a first or reducing metal capable of existing in two valence states. While it is not intended that we be bound by the theory, it is believed in the art that the noble metal ion is reduced to the metallic state where it can function as a catalytic site for silver deposition in a diffusion transfer process. Thus, the term "noble metal nuclei" is intended to include the metallic noble metal in colloidal form as well as alloyed with other materials such as the aforementioned first metal and the terms "reduce" and "reduction" are intended to refer to the chemical reaction by which the colloidal or alloyed form of the metal is obtained. While the noble metal nuclei are substantially in the metallic or alloyed form, it should be understood that minor amounts of noble metal complexes may be present. As examples of suitable materials for use as the first metal ion, mention may be made of iron, cobalt, nickel, bismuth, lead, titanium, vanadium, chromium, copper, molybdenum, antimony, tungsten and preferably tin.

Noble metal nuclei prepared by the procedure set forth in copending application Ser. No. 649,202, filed Jan. 14, 1976, (common assignee) may also be employed in the receiving elements of the present invention.

The term "polymer" as used therein is intended to include natural and synthetic polymers and include
gelatin
methyl cellulose
sodium salt of carboxymethyl cellulose
hydroxymethyl cellulose
hydroxyethyl cellulose
hydroxypropyl cellulose
carboxymethyl hydroxyethyl cellulose
alginic acid, sodium salt
agarose
polyvinyl alcohol
deacetylated chitin Successive coatings of the noble metal nucleating layers may be employed, in some cases, separated by layers of a suitable polymeric binder such as deacetylated chitin or gelatin. In a preferred embodiment, however, a single layer of the noble metal/polymer silver precipitating layer is coated.

The novel image-receiving element of the present invention is employed in silver diffusion transfer processing forms a positive silver image therein which is frequently characterized by a uniform mirror deposit of image silver believed to be a result of the relatively thin nuclei layer employed. The positive silver is more dense than that generally found in prior art image-receiving elements and is similar in properties to that obtained by vacuum deposited silver, which is believed to be the most compact form possible. The above-mentioned mirror effect is particularly desirable in photographic transparencies since it tends to increase the $D_{max}$ in projection images when the mirror is on the side of the support next to the projection light. The absorption spectrum of the silver transfer image is relatively neutral, i.e., similar to vacuum deposited silver. Thus, by means of the present invention, a thin, tightly packed matrix of nuceli can be prepared so that the image silver deposited therein is similar to vacuum deposited silver.

Combinations of noble metals may be used as well as single noble metals. In a preferred embodiment, noble metals salts or complexes may be reacted with reducing metal salts from aqueous salts of the noble metals. Suitable compounds include the following:
$K_2PdCl_4$
$PdCl_2$
$H_2PtCl_6$
$AgNO_3$
$HAuCl_4$ The ratio of first metal salt to noble metal salt or complex may range from about 1:1 to 4:1, and preferably 3:1, said ratios based on the weight of the metals.

The following non-limiting examples illustrate the novel process of the present invention:

EXAMPLE 1

The following solutions were prepared:

Solution A
165 cc water
0.65 g $K_2PdCl_4$
85 cc 1% hydroxyethylcellulose
250 cc 0.1% alkyl phenoxypolyoxyethylene ethanol surfactant (sold under the trade name PE-120 by NOPCO Chem. Div. of Diamond Shamrock Company)

The $K_2PdCl_4$ is dissolved in the water and to this solution is added the hydroxyethylcellulose and surfactant.

Solution B
165 cc water
1.0 g $SnCl_2$
85 cc 1% hydroxyethylcellulose
250 cc 0.1% alkylphenoxypolyoxyethylene ethanol surfactant The $SnCl_2$ is added to the water and to this mixture is added the hydroxyethylcellulose and surfactant.

Solutions A and B are quickly mixed together, stirred for 30 to 60 minutes and coated on suitable supports for use as silver precipitating layers.

The utility of such nuclei layers is described below.

EXAMPLE 2

A film unit was prepared comprising transparent polyester film base carrying on one surface an additive color screen of approximately 1000 triplets per inch of red, blue and green filter screen elements in repetitive side-by-side relationship; a 4 micron polyvinylidine chloride-polyvinyl formal protective overcoat layer; nucleating material prepared according to the procedure of Example 1 was slot coated over said protective layer; a gel coat (50 mgs/ft$^2$) prepared by adding 26 g. of a 10% inert gel solution to 72 cc of water, heating to 39° C. and mixing until homogenous and then adding 3 cc of a 1% solution of octylphenoxy polyethoxy ethanol surfactant; a hardened gelatino silver iodochloro emulsion coated at a coverage of about 115 mgs/ft$^2$ of gelatin and about 100 mgs/ft$^2$ of silver with about 7.18 mgs/ft$^2$ propylene glycol alginate and about 0.45 mgs/ft$^2$ of sodium dioctyl sulfosuccinate panchromatically sensitized with 5,5'-dimethyl-9-ethyl-3,3'-bis-(3 sulfopropyl) thiacarbocyanine triethyl-ammonium salt; 5,5'-diphenyl-9-ethyl-3,3'-bis(4-sulfobutyl) oxacarbocyanine; and 100 mgs/ft$^2$ of one of the following antihalo top coats. The antihalo top coats referred to below are disclosed and claimed in copending application Ser. No. 383,261, filed July 27, 1973.

| Top Coat A | Wt. % |
|---|---|
| Sodium bis-1,5[3-carboxy-1-(p-N-n-pentyl sulfonamido-phenyl)-2-pyrazolin-5-one] pentamethane oxonol | 0.13 |
| Distilled Water | 65.18 |
| 4-(2-chloro-4-dimethylaminobenzaldehyde-1-(p-phenyl carboxylic acid)-3-methyl pyrazalone-5 | 0.01 |
| Gelatin (15% solution) | 34.59 |
| Daxad-11 (polymerized sodium salts of alkyl naphthalene sulfonic acid) Manufactured by W. R. Grace & Co., Cambridge, Mass. | 0.007 |

| Top Coat B | |
|---|---|
| Gelatin | 0.02 |
| Benzimidazole thiol gold complex | 0.35 |
| Distilled water | 6.66 |
| Pyridinium bis-1,5(1,3-diethyl-2-thiol-5-barbituric acid) pentamethine oxanol | 0.22 |
| 4-(2-chloro-4-dimethylamino benzaldehyde)-1-(p-phenyl carboxylic acid)-3-methyl pyrazolone-5 | 0.28 |
| Gelatin (10% solution) | 92.46 |
| Daxad-11 (polymerized sodium salts of alkyl naphthalene sulfonic acid) Manufactured by W. R. Grace & Co., Cambridge, Mass. | 0.01 |

The above-described film unit was given an 8 mcs exposure and was processed through mechanical lab rollers at a 3.0 mil gap disposing one of the processing compositions set forth below between the top coat and a gelatin coated cover sheet. The film unit was held in the dark for 1 minute and the neutral column was read to white, red, green and blue light in an automatically recording densitometer.

| Processing Composition A | Wt. % |
|---|---|
| Water | 79.02 |
| Sodium hydroxide | 6.97 |
| Hydroxyethyl cellulose | 2.70 |
| Sodium sulfite | 2.44 |
| 2-methylthiomethyl-4,6-dihydroxypyrimidine | 4.06 |
| Tetramethyl reductic acid | 3.26 |
| 1,12-dodecamethylene-bis-(pyridinium) bromide | 1.70 |
| 4-amino-pyrazalo-[3.4-]pyrimidine | 0.015 |
| 5-bromo-6-methyl azabenzimidazole | 0.015 |
| Thiazolidine thione | 0.034 |

| Processing Composition B | Wt. % |
|---|---|
| Water | 75.89 |
| Sodium hydroxide | 0.87 |
| Potassium hydroxide | 8.61 |
| Hydroxyethyl cellulose | 0.95 |
| Tetramethyl reductic acid | 3.86 |
| Potassium sulfite | 3.79 |
| 2-methylthiomethyl-4,6-dihydroxypyrimidine | 5.75 |
| 1,12-dodecamethylene-bis-(pyridinium) bromide | 0.82 |
| 4-amino-pyrazolo-[3,4-]pyrimidine | 0.061 |

Film units within the scope of the present invention were prepared and processed according to the procedures of Examples 1 and 2 with the indicated ratios of components, top coats and processing compositions.

TABLE 1

| Example No. | Pd | Aim Coverage mgs/ft$^2$ Hydroxyethyl Cellulose | Gelatin | Sn | White Light | Red | $D_{max}$ Green | Blue | $D_{min}$ (White Light) | Slope |
|---|---|---|---|---|---|---|---|---|---|---|
| 3 | 0.25 | 1.02 | — | 0.75 | 2.74 | 2.74 | 2.75 | 2.74 | 0.13 | 3.4 |
| 4 | 0.25 | 0.72 | — | 0.75 | 2.42 | 2.34 | 2.55 | 2.60 | 0.38 | 1.7 |
| 5 | 0.25 | — | 1.02 | 0.75 | 2.26 | 2.16 | 2.56 | 2.70 | 0.21 | 2.5 |
| 6 | 0.25 | 0.51 | — | 0.75 | 1.45 | 1.36 | 1.52 | 1.49 | 0.21 | — |
| 7 | 0.25 | 0.36 | — | 0.46 | 2.17 | 2.16 | 2.23 | 2.14 | 0.60 | 1.3 |

Examples 3 and 5 employed Top Coat A and Processing Composition B.

Examples 4 and 7 employed Top Coat B and Processing Composition A.

Example 6 employed Top Coat B and Processing Composition B.

The nuclei solutions in Examples 6 and 7 were deaerated before coating.

EXAMPLE 8

The following solutions were prepared:

Solution A 0.5 g. $SnCl_2.2H_2O$ 100 g. 1.0% acetic acid

Water to make 100.5 g. total

Solution B 10 g. 1% gelatin solution

Solution C 0.286 g. $PdCl_2$ 100 g. 2.0% acetic acid

Dissolution carried out with stirring at about 40° C.

The nuclei were formed by bringing 145 g. of water to a boil in a flask with a magnetic stirrer. 20 g. of Solution A was added and, after one-half minute, 5 g. of Solution B. The mixture was allowed to come to a boil again and stirred vigorously while 20 g. of Solution C was added. After stirring for another one-half minute, the mixture was cooled to room temperature within five minutes. Sufficient water was then added to make up a total of 190 g. As a coating aid, 20 mls. of 0.1% alkyl phenoxypolyoxy-ethylene ethanol surfactant (sold under the trade name PE120 by NOPCO Chem. Div. of Diamond Shamrock Company) were added.

In an alternative procedure the nuclei are formed at room temperature. To differentiate the variations in the procedures the nuclei formed at elevated temperature will be designated "HOT" and the nuclei formed at room temperature designated "Room Temperature".

EXAMPLE 9

Film units were prepared according to the procedure of Example 2 except that the gel layer between the receiving layer and the emulsion layer was replaced with a copper-chitin layer prepared as follows:

To a solution comprising:

3300 g. distilled water
3.316 g. copper acetate
0.914 g. sodium acetate was added a solution comprising:

279.413 g. distilled water
9.065 g. acetic acid
11.522 g. deacetylated chitin

The thus-formed solution was coated to provide a layer of 7 mgs/ft$^2$.

The above-described copper-chitin layer is claimed in application Ser. No. 697,104, filed June 17, 1976 (common assignee), now U.S. Pat. No. 4,056,392 issued Nov. 1, 1977.

Film units within the scope of the present invention were prepared according to the procedures of Examples 8 and 9 and processed according to the procedure of Example 2 with the indicated ratios of components, top coats and processing compositions.

| Processing Composition C | Wt. % |
|---|---|
| Water | 66.2 |
| Sodium hydroxide | 7.1 |
| Hydroxyethyl cellulose | 0.9 |
| Tetramethyl reductic acid | 11.1 |
| Sodium sulfite | 0.8 |
| Sodium thiosulfate | 12.4 |
| N-benzyl-α-picolinium bromide (50% solution) | 1.4 |

| Processing Composition D | Wt. % |
|---|---|
| Water | 70.6 |
| Sodium hydroxide | 7.5 |
| Hydroxyethyl cellulose | 0.9 |
| Tetramethyl reductic acid | 11.7 |
| Sodium sulfite | 2.2 |
| Sodium thiosulfate | 5.3 |
| N-benzyl-α-picolinium bromide (50% solution) | 1.7 |
| 4-amino-pyrazolo-[3,4-]pyrimidine | 0.02 |

-continued

| Processing Composition D | Wt. % |
|---|---|
| Bromomethyl azabenzimidazole | 0.03 |

| Processing Composition E | Wt. % |
|---|---|
| Water | 70.4 |
| Sodium hydroxide | 7.3 |
| Hydroxyethyl cellulose | 0.6 |
| Tetramethyl reductic acid | 7.5 |
| Potassium sulfite | 3.6 |
| 2-methylthiomethyl-4,6-dihydroxy-pyrimidine | 7.5 |
| N-benzyl-α-picolinium bromide (50% solution) | 3.0 |

| Top Coat C | Wt. % |
|---|---|
| Gelatin | 0.03 |
| Benzimidazole thiol gold complex | 0.41 |
| Distilled water | 44.84 |
| Pyridinium bis-1,5(1,3-diethyl-2-thiol-5-barbituric acid) pentamethine oxanol | 0.13 |
| 4-(2-chloro-4-dimethylamino benzaldehyde)-1-(p-phenyl carboxylic acid)-3-methyl pyrazolone-5 | 0.16 |
| Gelatin (10% solution) | 54.41 |
| Daxad-11 (polymerized sodium salts of alkyl naphthalene sulfonic acid) manufactured by W. R. Grace & Co., Cambridge, Mass. | 0.01 |

| Top Coat D | Wt. % |
|---|---|
| Gelatin | 0.03 |
| Benzimidazole thiol gold complex | 0.41 |
| Distilled water | 45.35 |
| Pyridinium bis-1,5(1,3-diethyl-2-thiol-5-barbituric acid) pentamethine oxanol | 0.13 |
| 4-(2-chloro-4-dimethylamino benzaldehyde)-1-(p-phenyl carboxylic acid)-3-methyl pyrazolone-5 | 0.16 |
| Gelatin (10% solution) | 53.92 |
| Daxad-11 (polymerized sodium salts of alkyl naphthalene sulfonic acid) manufactured by W. R. Grace & Co., Cambridge, Mass. | 0.01 |

| Top Coat E | Wt. % |
|---|---|
| Gelatin | 0.03 |
| Benzimidazole thiol gold complex | 0.02 |
| Distilled water | 27.45 |
| Pyridiunium bis-1,5(1,3-diethyl-2-thiol-5-barbituric acid) pentamethine oxanol | 0.13 |
| 4-(2-chloro-4-dimethylamino benzaldehyde)-1-(p-phenyl carboxylic acid)-3-methyl pyrazolone-5 | 0.16 |
| Gelatin (10% solution) | 72.02 |
| Daxad-11 (polymerized sodium salts of alkyl naphthalene sulfonic acid) manufactured by W. R. Grace & Co., Cambridge, Mass. | 0.01 |

TABLE 2

| Example No. | Aim Coverage mgs/ft² Pd | Gelatin | $D_{max}$ Red | Green | Blue | $D_{min}$ (white light) |
|---|---|---|---|---|---|---|
| 10 | 0.20 | 0.10 | 2.68 | 2.72 | 2.68 | 0.34 |
| 11 | 0.20 | 0.20 | 2.80 | 2.88 | 2.83 | 0.32 |
| 12 | 0.20 | 0.40 | 2.60 | 2.80 | 2.76 | 0.36 |
| 13 | 0.20 | 0.10 | 2.82 | 2.83 | 2.80 | 0.36 |
| 14 | 0.20 | 0.20 | 2.80 | 2.74 | 2.71 | 0.33 |
| 15 | 0.20 | 0.40 | 2.80 | 2.90 | 2.84 | 0.30 |

The following table shows the photographic results obtained with nuclei prepared according to Example 8 and incorporated with film units prepared and processed according to the procedure of Example 9 with varying levels of noble metal nuclei.

TABLE 3

| Example | Aim Coverage mgs/ft² Pd | Gelatin | $D_{max}/D_{min}$ Red | Green | Blue |
|---|---|---|---|---|---|
| 16 | 0.2 | 0.2 | 3.20/0.41 | 3.10/0.42 | 2.93/0.46 |
| 17 | 0.07 | 0.07 | 3.11/0.41 | 3.09/0.39 | 2.94/0.41 |

In Examples 16 and 17 Processing Composition D and Top Coat D were employed.

EXAMPLE 18

Nuclei were prepared according to the procedure of Example 8 and incorporated into a film unit according to the procedure of Example 9 except that a copper-gelatin layer was substituted for the copper-chitin layer with the same quantity of materials employed. At a 0.2 mgs/ft² palladium coverage and a 1:1 gelatin/palladium ratio the following transmission densities were obtained on the film units.

| | Red | Green | Blue |
|---|---|---|---|
| $D_{max}$ | 2.95 | 2.75 | 2.65 |
| $D_{min}$ | 0.42 | 0.36 | 0.44 |

Processing Composition D and Top Coat D were employed.

EXAMPLE 19

Nuclei were prepared according to the procedure of Example 8 except that potassium palladous tetra chloride was substituted for palladium chloride. The nuclei were incorporated into a film unit according to the procedure of Example 9. At a 0.2 mgs/ft² palladium coverage and a 1:1 gelatin/palladium ratio the following transmission densities were obtained.

| | Red | Green | Blue |
|---|---|---|---|
| $D_{max}$ | 3.33 | 3.15 | 3.00 |
| $D_{min}$ | 0.43 | 0.39 | 0.42 |

Processing Composition D and Top Coat D were employed.

EXAMPLE 20

The procedure of Example 8 was modified by the substitution of 0.235 g. of sodium hypophosphite in 100 g. of water for the stannous chloride reducing agent.

EXAMPLE 21

The procedure of Example 8 was modified by the substitution of 0.084 g. of sodium borohydride in 100 g. of water for the stannous chloride reducing agent. Nuclei prepared employing these reducing agents were incorporated in film units described in Example 9 and processed with the following results obtained:

TABLE 4

| Example | Aim Coverage mgs/ft² Pd | Gelatin | Red | Green | Blue | Green $D_{min}$ |
|---|---|---|---|---|---|---|
| 20 | 0.20 | 0.20 | 3.37 | 3.06 | 2.79 | 0.38 |
| 21 | 0.20 | 0.20 | 3.28 | 3.12 | 2.78 | 0.33 |

Processing Composition E and Top Coat E were employed.

As stated above, the preferred polymer employed in the receiving layers of the present invention comprises gelatin. Gelatin at the low end of the nuclei-binder ratio can be employed to provide good density, neutral tone positive images in the receiving layer whereas the preferred levels of other polymers, such as hydroxyethyl cellulose are at the higher portions of the nuclei-binder range.

In an alternative embodiment, the colloid formed by the reduction of the noble metal salt or complex is dialyzed before coating. The effect of the dialysis is to provide enhanced stability to the coating composition. While not intending to be bound by theory, it is believed that this enhanced stability is a result of the pH being raised and/or the removal of certain ions, such as $H^+$, $K^+$ and $Cl^-$.

In still a further embodiment, the pH of the above-mentioned colloid is changed from acid to alkaline resulting in the precipitation of the noble metal, which can then be separated, washed and redispersed in a polymer and coated. Any unwanted by-products or starting materials are thereby removed.

The particle size of the silver precipitating nuclei of the present invention may vary over a relatively wide range. In a preferred embodiment, the nuclei range from about 15A° to about 65A°. For example, nuclei prepared according to the procedure of Example 1, on a 1000 particle count, have a mean diameter of about 20A° with 80% of the particles having a diameter between 17A° and 40A°. Nuclei prepared according to Example 8, on a 1000 particle count, have a mean diameter of about 31A° with 80% of the particles having a diameter between 19A° and 46A°.

The support employed in the present invention is not critical. The support of film base employed may comprise any of the various types of transparent rigid or flexible supports, for example, glass, polymeric films of both the synthetic type and those derived from naturally occurring products, etc. Especially suitable materials, however, comprise flexible transparent synthetic polymers such as polymethacrylic acid, methyl and ethyl esters; vinyl chloride polymers; polyvinyl acetals; polyamides such as nylon; polyesters such as the polymeric films derived from ethylene glycol terephthalic acid; polymer cellulose derivatives such as cellulose acetate, triacetate, nitrate, propionate, butyrate, acetate-butyrate; or acetate propionate; polycarbonates; polystyrenes; and the like.

The additive color screen employed in the present invention may be formed by techniques well known in the art, e.g., by sequentially printing the requisite filter patterns by photomechanical methods. An additive color screen comprises an array of sets of colored areas or filter elements, usually from two to four different colors, each of said sets of colored areas being capable of transmitting visible light within a predetermined wavelength range. In the most common situations the additive color screen is trichromatic and each set of color filter elements transmits light within one of the so-called primary wavelengths ranges, i.e., red, green and blue. The additive color screen may be composed of minute dyed particles, such as starch grains or hardened gelatin particles, intermixed and interspersed in a regular or random arrangement to provide a mosaic. A regular mosaic of this type may be made by the alternating embossing and doctoring technique described in U.S. Pat. No. 3,019,124. Another method of forming a suitable color screen comprises multi-line extrusion of the type disclosed in U.S. Pat. No. 3,032,008, the colored lines being deposited side-by-side in a single coating operation. Still another method is set forth in U.S. Pat. No. 3,284,208. Silver halide solvents useful in forming the desired soluble complex with unexposed silver are well known and, for example, may be selected from the alkali metal thiosulfates, particularly sodium or potassium thiosulfates, or the silver halide solvent may be cyclic amide, such as uracil, in combination with a nitrogenous base as taught in U.S. Pat. No. 2,857,274 issued Oct. 21, 1958, to Edwin H. Land. While the silver halide solvent is preferably initially present in the processing composition, it is within this invention to initially position the silver halide solvent in a layer of the film unit, preferably in the form of a precursor which releases or generates the silver halide solvent upon contact with an alkaline processing fluid.

The processing composition may contain a thickening agent, such as an alkali metal carboxymethyl cellulose or hydroxyethyl cellulose, in a quantity and viscosity grade adapted to facilitate application of the processing composition. The processing composition may be left on the processed film or removed, in accordance with known techniques, as is most appropriate for the particular film use. The requisite alkalinity, e.g., a pH of 12–14 , is preferably imparted to the processing composition, such as sodium, potassium and/or lithium hydroxide. A wetting agent may be advantageously included in the processing composition to facilitate application thereof, particularly where the processing composition is applied in a very thin layer of low viscosity fluid.

Suitable silver halide developing agents may be selected from amongst those known in the art, and may be initially positioned in a layer of the photosensitive element and/or in the processing composition. Organic silver halide developing agents are generally used, e.g., organic compounds of the benzene or naphthalene series containing hydroxyl and/or amino groups in the para- or ortho-positions with respect to each other , such as hydroquinone, tert-butyl hydroquinone, toluhydroquinone, p-aminophenol, 2,6-dimethyl-4-aminophenol, 2,4,6-triaminophenol, etc. If the additive color transparency is one which is not washed after processing to remove unused silver halide developing agent, development reaction products, etc., the silver halide developing agent(s) should not give rise to colored reaction products which might stain the image or which, either unreacted or reacted, might adversely affect the stability and sensitometric properties of the final image. Particularly useful silver halide developing agents having good stability in alkaline solution are substituted reductic acids, particularly tetramethyl reductic acid, as disclosed in U.S. Pat. No. 3,615,440 issued October 26, 1971 to Stanley M. Bloom and Richard D. Cramer, and $\alpha,\beta$-enediols as disclosed in U.S. Pat. No. 3,730,716 issued to Edwin H. Land, Stanley M. Bloom and Leonard C. Farney on May 1, 1973.

We claim:

1. An additive diffusion transfer film unit consisting essentially of a transparent support carrying, in order, an additive color screen, a silver precipitating layer comprising noble metal silver precipitating nuclei and a polymer; wherein said nuclei are present in a level of about 0.1–0.3 mgs/ft$^2$; and said polymer is present at a level of from about 0.5 to 5 times the coverage of said nuclei and said layer being not more than about 2 mgs/ft$^2$; wherein said silver precipitating layer is the sole layer containing silver precipitating nuclei; and a photosensitive silver halide emulsion layer.

2. The product of claim 1 wherein said nuclei are obtained by the reduction of a noble metal salt or complex.

3. The product of claim 2 wherein said reduction is effected by a first metal capable of two valences.

4. The product of claim 1 wherein said nuclei are present at a level of about 0.2 mgs/ft$^2$.

5. The product of claim 1 wherein said polymer is gelatin.

6. The product of claim 1 wherein said polymer is hydroxyethyl cellulose.

7. The product of claim 1 wherein said polymer present at a level of about 1 times that of the nuclei.

8. The product of claim 5 wherein said nuclei is present at a level of about 0.2 mgs/ft$^2$.

9. The product as defined in claim 1 wherein said noble metal is palladium.

10. The product as defined in claim 3 wherein said first metal is tin.

11. The product as defined in 10 wherein said noble metal salt is palladous chloride and said first metal is provided by stannous chloride.

12. The product of claim 1 which includes an antihalation layer.

* * * * *